US005398479A

United States Patent [19]

Diete et al.

[11] Patent Number: 5,398,479

[45] Date of Patent: Mar. 21, 1995

[54] APPARATUS FOR INSERTING GOODS INTO HOLLOWS FOR PACKAGING

[75] Inventors: Günter Diete, Obergünzburg; Christoph Ullmann, Kempten; Helmut Spittler-Herrmann, Wiggensbach, all of Germany

[73] Assignee: Dixie-Union Verpackungen GmbH, Kempten, Germany

[21] Appl. No.: 51,653

[22] Filed: Apr. 26, 1993

[30] Foreign Application Priority Data

May 12, 1992 [DE] Germany ..... 42 15 546.0

[51] Int. Cl.[6] ..... B65B 5/06

[52] U.S. Cl. ..... 53/260; 53/540; 53/258; 53/261

[58] Field of Search ..... 53/532, 540, 248, 254, 53/255, 258, 260, 261, 262

[56] References Cited

U.S. PATENT DOCUMENTS

| | | | |
|---|---|---|---|
| 1,915,489 | 6/1933 | Gere | 53/262 |
| 2,031,005 | 2/1936 | Renfroe | 53/262 |
| 2,736,477 | 2/1956 | Krebs et al. | 53/260 |
| 3,001,350 | 9/1961 | Heblij | 53/261 X |
| 3,105,333 | 10/1963 | Desnick | 53/260 X |
| 3,778,965 | 12/1973 | O'Lenick et al. | 53/258 X |
| 3,803,799 | 4/1974 | Mosterd | 53/260 X |
| 4,048,784 | 9/1977 | Toby | 53/260 X |
| 4,099,711 | 7/1978 | Grody et al. | 53/260 X |
| 4,192,121 | 3/1980 | Caudle | 53/261 X |
| 4,416,103 | 11/1983 | Ewer et al. | 53/248 X |
| 4,478,024 | 10/1984 | Vedvik et al. | 53/260 X |
| 4,648,237 | 3/1987 | Total | 53/258 X |
| 4,712,355 | 12/1987 | Dorner et al. | 53/260 X |
| 4,800,706 | 1/1989 | Dorner | 53/261 X |
| 4,827,692 | 5/1989 | Fiske et al. | 53/254 X |
| 5,018,338 | 5/1991 | Jurchuk et al. | 53/260 X |
| 5,069,019 | 12/1991 | Lodewegen | 53/532 X |

FOREIGN PATENT DOCUMENTS

| | | | |
|---|---|---|---|
| 4029359 | 3/1992 | Germany . | |
| 962105 | 10/1982 | U.S.S.R. | 53/260 |

*Primary Examiner*—John Sipos
*Assistant Examiner*—Daniel Moon
*Attorney, Agent, or Firm*—Jacobson, Price, Holman & Stern

[57] ABSTRACT

An apparatus for inserting stacks of goods (1), for example sausage slices, into hollow containers (4) for packaging, the interior size of the hollow containers (4) corresponding substantially to the dimensions of the goods, includes grippers (2, 7) some of which (7) remain substantially above the edge of the opening of the hollow containers during the insertion procedure and some of which (2) are insertable slightly in the opening to facilitate depositing the goods in the desired position for packaging. Extension members (5) which grip below the goods for packaging can also be provided.

6 Claims, 5 Drawing Sheets

APPARATUS FOR INSERTING GOODS INTO HOLLOWS FOR PACKAGING

BACKGROUND OF THE INVENTION

The invention relates to an apparatus for inserting goods into hollow portions of hollow containers in packaging, the size of the hollow portions being matched to the dimensions of the goods, whereby the goods are gripped by a plurality of lateral grippers which bear against the periphery of the goods.

It is known to pack goods, for example pieces of sausage or cheese, in pre-shaped containers having hollow interiors, hereinafter referred to as hollows. The hollows are then closed by a film which is, for example, then welded or sealed to the edge of the hollow. In general, a plurality of rows of hollows are shaped in a film by a deep-drawing procedure and are then continuously filled and covered by an upper film and closed. Then the individual hollows are separated by cutting. Optionally, the hollows may be evacuated or filled with gas.

If the hollows are sufficiently large to receive the goods, as a rule the insertion procedure presents no difficulty. The goods for packaging can for example be held against the corresponding transport apparatus by suction and moved in this way. However, the application of suction is no use if the goods are air-permeable, or if stacks are packaged. Particularly with cheese or sausage, but also with biscuits and other goods, stacks have to be laid in hollows.

The insertion procedure is made even more difficult if the hollows are matched to the outlines of the goods as precisely as possible. Such precise matching is desirable in order to save on material as far as the goods are concerned and also in order to facilitate the evacuation and gas filling procedures. Moreover, an excessively large hollow would create the impression that the package were only partially filled.

However, if the hollow is matched to the outlines of the goods it is difficult to mechanize the insertion procedure. As a rule, such goods are inserted by hand.

German Patent Document No. DE-OS 40 29 359 describes an insertion apparatus for the packaging of stack-shaped goods, in which grippers bear laterally against the goods for packaging and grip below the goods with hook ends. The goods are laid in the hollows using this apparatus. Once this has happened, the hook ends are rotated or swivelled so that the grippers can be retracted.

BRIEF SUMMARY OF THE INVENTION

The object of the invention is to provide an apparatus of the generic type described above whereby goods can be successfully inserted into packaging hollows even if the hollows are matched to the dimensions of the goods as precisely as possible and if it is not possible or recommended to use pneumatic lifting apparatus or similar means.

To achieve this object, the invention provides apparatus for inserting goods into hollows for packaging, where the hollows have upper edges and are matched in dimensions to the goods. The apparatus comprises a plurality of lateral grippers including gripper members which bear against the periphery of the goods. The grippers remain substantially above the edges of the hollows, or reach only slightly into the hollows, during the insertion procedure.

If the hollow is matched optimally to the dimensions of the goods, there is only negligible space or no utilizable space between the external dimensions of the goods and the hollow wall. Preferably, the hollow wall is of synthetic material which is in particular deep-drawn. This manufacturing procedure leads to a reduction in the wall thickness in the drawn region of the film. There is thus a considerable risk of the grippers and the associated apparatus damaging the hollow wall during the procedure.

It is precisely in those cases when the hollows are produced by deep-drawing or a comparable procedure that as a general rule the hollows have conical walls, that is to say the hollows are somewhat wider at the upper edge than at the hollow base.

The invention is based on the realization that it is sufficient for the insertion apparatus to bring the goods precisely above the hollow. However, it is not necessary for the insertion apparatus itself to penetrate entirely into the hollow. If the insertion apparatus releases the goods in this position, the goods will enter the hollow and it becomes possible to make the dimensions of the hollow and of the goods largely correspond to one another.

It is even possible for the tips of the grippers to extend slightly into the hollow, for example utilizing the space provided by the conical shape of the hollow.

Insertion can be effected for example by the grippers releasing the goods for packaging so that they fall into the hollow. However, it is also possible to use ejectors which convey the goods into the hollow.

A further advantage of the invention is that the insertion procedure can take place more rapidly than in cases where the insertion apparatus enters the hollow entirely with the goods and has to withdraw again after release.

The invention can be used in particular for stacked goods. However, it can also be used for single-piece goods.

The invention further provides that extension pieces be provided on the grippers to grip under the goods, the extension pieces remaining above the hollow during the insertion procedure. The fact that the extension pieces remain above the hollow has the significant advantage that there is sufficient space available for the elements connecting these extension pieces to the grippers or allowing them to cooperate with the grippers. This makes a stable construction possible, which is in turn a prerequisite for a high working speed.

In particular, the invention provides that the extension pieces be bendable. The extension pieces can also be constructed for example to be resilient.

Such a construction is recommended if an ejector is provided which strips the goods from the grippers. In this case, the extension pieces are easily deformed and return to the starting position after the ejector has retracted without a special mechanism being necessary.

In accordance with a further feature of the invention, the grippers move away from the goods in the depositing position. This accentuates the advantage of the main feature of the invention.

In accordance with a further feature of the invention, arms are provided which bear the extension pieces at their end. These arms extend substantially parallel to the gripper members, the gripper members and the arms preferably being driven separately from one another.

It is favorable for the gripper members to have cutouts for the extension pieces borne by the arms. By this means, the gripper members can project towards the hollow beyond the extension pieces, and can reach into the hollow by means of the projecting parts. Thus, during the insertion procedure the goods are still guided to some extent, which ensures that the goods are laid in the hollow in the manner intended, for example in a precise stack, the hollow tightly surrounding the stack.

In another embodiment of the invention, the extension pieces borne by the arms are arranged below the gripper members.

The invention further provides that the gripper members may be shaped in the manner of dishes and that the facing edges of the dish-like gripper members may be provided with rounded ends. In this manner, the possibility of the goods being damaged when the grippers close is prevented. In this connection, it should be noted that the goods in question often have a sensitive surface and are thus subjected to stress during the insertion procedure.

It is favorable for drive of the gripper members or of the arms to be derived from the ejector, in particular by means of a cam surface on the ejector.

As already mentioned, the invention is based essentially on the idea of laying the goods, especially when these are stacked slices, in hollows which are matched in size as optimally as possible to the goods. It has been found that the achievement of this aim is facilitated by operating in accordance with the process now described.

The process according to the invention preferably, though not necessarily, uses the apparatus described above. However, the process according to the invention can also be used in cases in which the grippers laterally gripping the stack of goods penetrate entirely into the hollow during the insertion process.

The process according to the invention is characterized in that the stacks are formed on a convex upwardly curved support and are inserted into a hollow in the shape so obtained, which is maintained by lateral grippers. Stacking on a support curved in this way reduces, for example with circular slices, the dimensions in plan view. As a result of the curvature, the external diameter is reduced. In this way space is obtained for the grippers. A further advantage is that, as a result of the curved shape of the stack of goods, the stability of the goods is improved. In many cases, the friction alone between the grippers gripping the outer periphery of the goods is sufficient to hold the goods securely. If extension pieces which grip under the stack are provided, these can have small dimensions. The small dimensions in turn also permit penetration of the grippers into the hollow or release and backward movement.

Once the stack has been laid in the hollow, it readopts its normal shape, that is to say with planar lower and upper surface. The hollow is completely filled.

BRIEF DESCRIPTION OF THE DRAWINGS

The invention will now be described in detail with reference to the accompanying drawings, wherein.

DETAILED DESCRIPTION OF PREFERRED EMBODIMENTS

Figure 1:
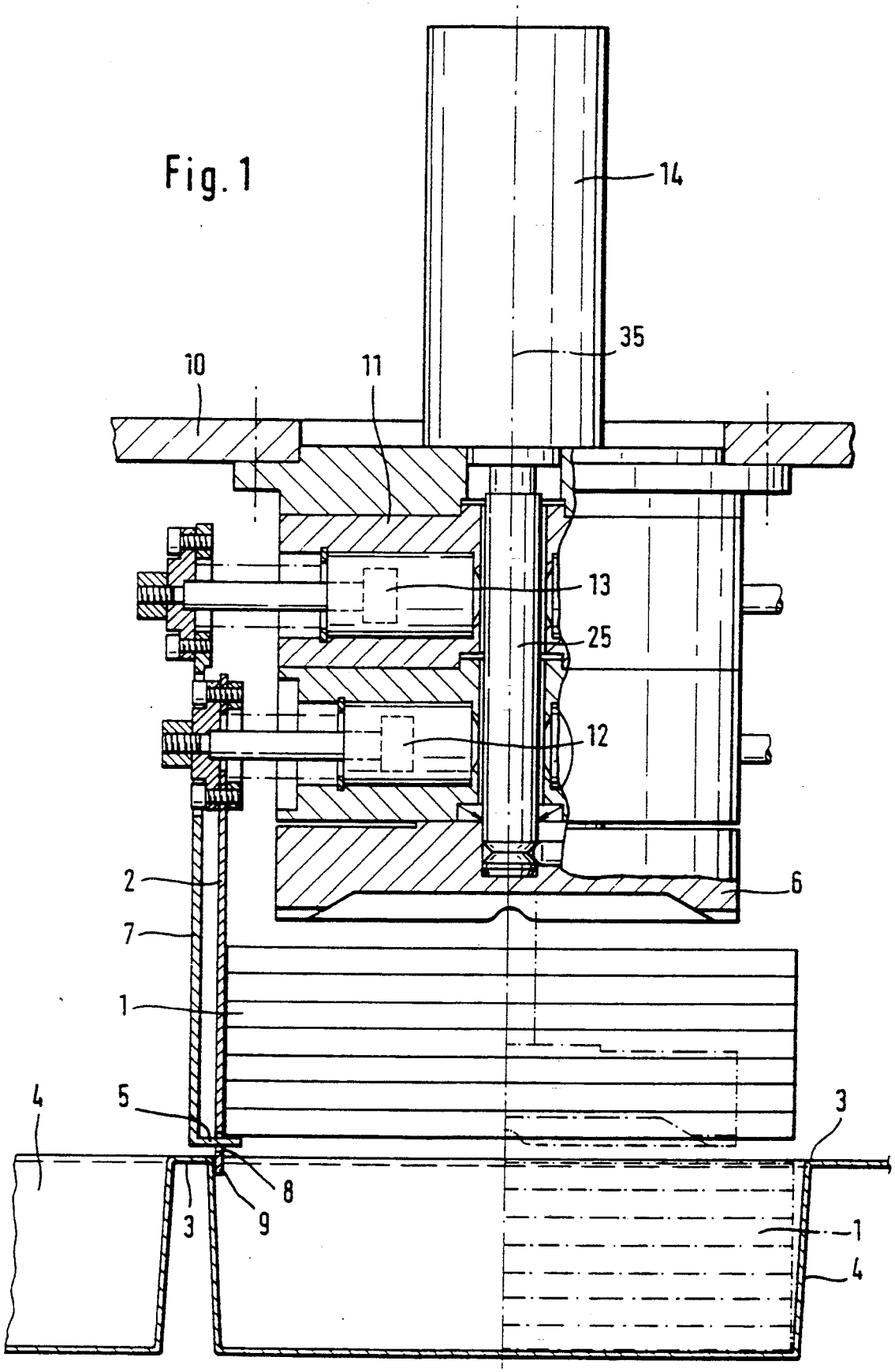
FIG. 1 is a cross sectional view of an apparatus according to the invention, in two operating positions.

FIG. 1 shows an apparatus for inserting goods into packaging, the apparatus being secured to a carrier plate 10. This carrier plate 10 generally supports a plurality of such apparatus and moves, by means not illustrated in detail, between a position in which the goods or the stack of goods are deposited and the position at which hollows 4 are located. The hollows 4 are generally, though not necessarily, shaped in a film by a deep-drawing procedure. For the insertion procedure, the hollows 4 are here fixed for example by suction to a support which also has apparatus for precisely positioning the hollows 4. In this manner, it is ensured that when the carrier plate 10 moves the apparatus in each case reaches the desired depositing point.

Figure 2:
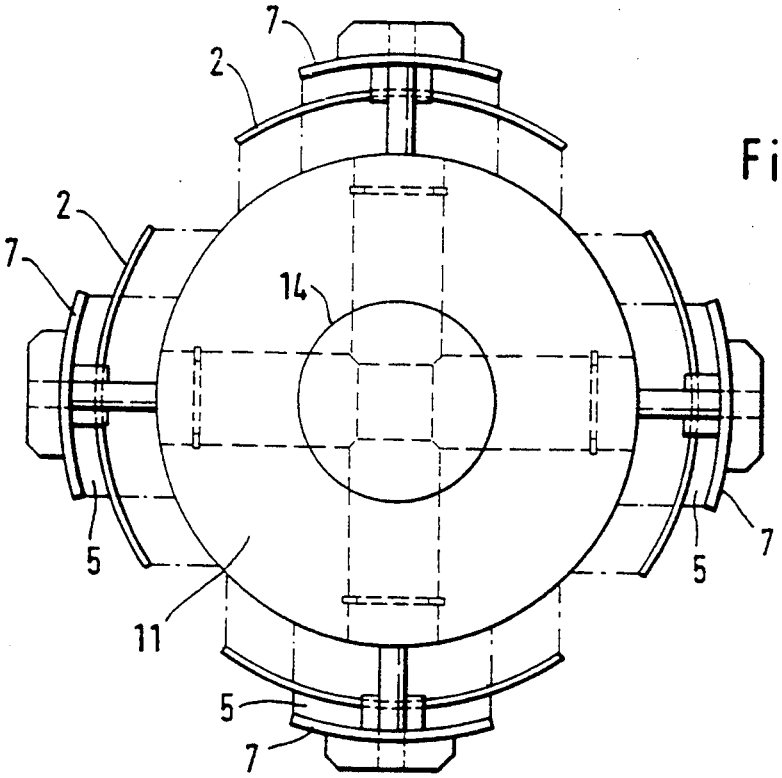
FIG. 2 is a top plan view of the essential parts of FIG. 1, some parts being omitted for clarity.

On the left-hand side of FIG. 1 there is shown the position of grippers 2 and levers 7 which the latter adopt shortly before depositing a stack of goods 1. The gripper member 2, which is part of a cylindrical dish, as shown in FIG. 2, bears against the outer periphery of the stack 1. A total of four grippers 2 are provided which, in the contact position against the stack 1, virtually complete the cylindrical shape.

The grippers 2 in particular also have the task of calibrating the stack. During the stacking procedure, the fact that the individual slices of the stack do not lie precisely on top of one another has to be reckoned with. When the grippers 2 bear against the stack, these grippers moving towards one another concentrically, the stack is brought into the desired shape.

For each of the individual grippers 2 there is provided in the head part 11, which is connected to the carrier plate 10, a pneumatic cylinder 12. These pneumatic cylinders are for example acted upon together and effect the radial movement with respect to the center axis 35.

In the same way as the grippers 2, the arms 7 are also each movable by means of a pneumatic cylinder 13 in the head part 11. The arms 7 carry extension pieces 5 at their lower ends for which cutouts 8 are provided in the lower end of the grippers 2. In the transport position in which the stacks are conveyed to above the hollows 4, the extension pieces 5 reach slightly below the edges of the stacks 1 and hold them firmly. In some cases, it is possible to dispense with these extension pieces 5 or the arms 7, in particular if the friction between the periphery of the stacks 1 and the grippers 2 is sufficient to hold the stacks securely.

Once the position shown in FIG. 1 has been reached, the arms 7 are retracted somewhat by the pneumatic cylinders 13, as shown in the drawing.

To insert the stacks into the hollows 4 an ejector 6 is provided which is driven by a further pneumatic cylinder 14 by means of a piston rod 25. The ejector 6 presses the stacks downwards. They are released from the grippers 2 and are deposited in the hollow 4, as shown on the right-hand side of FIG. 1.

The part 9 at the lower end of the grippers 2 which projects beyond the cutouts 8 can reach into the upper part of the hollow during the insertion procedure. This is achieved by suitable vertical movement of the support plate 10 at the end of the transport movement.

FIG. 2 shows that the arms 7 are narrower than the grippers 2, so that the extension pieces 5 provide support for the stack 1 only over part of the region acted on by the grippers 2. However, this construction should be understood merely as an example. It is also possible for the extension pieces 5 to extend over the same periphery as the grippers 2.

Figure 3:
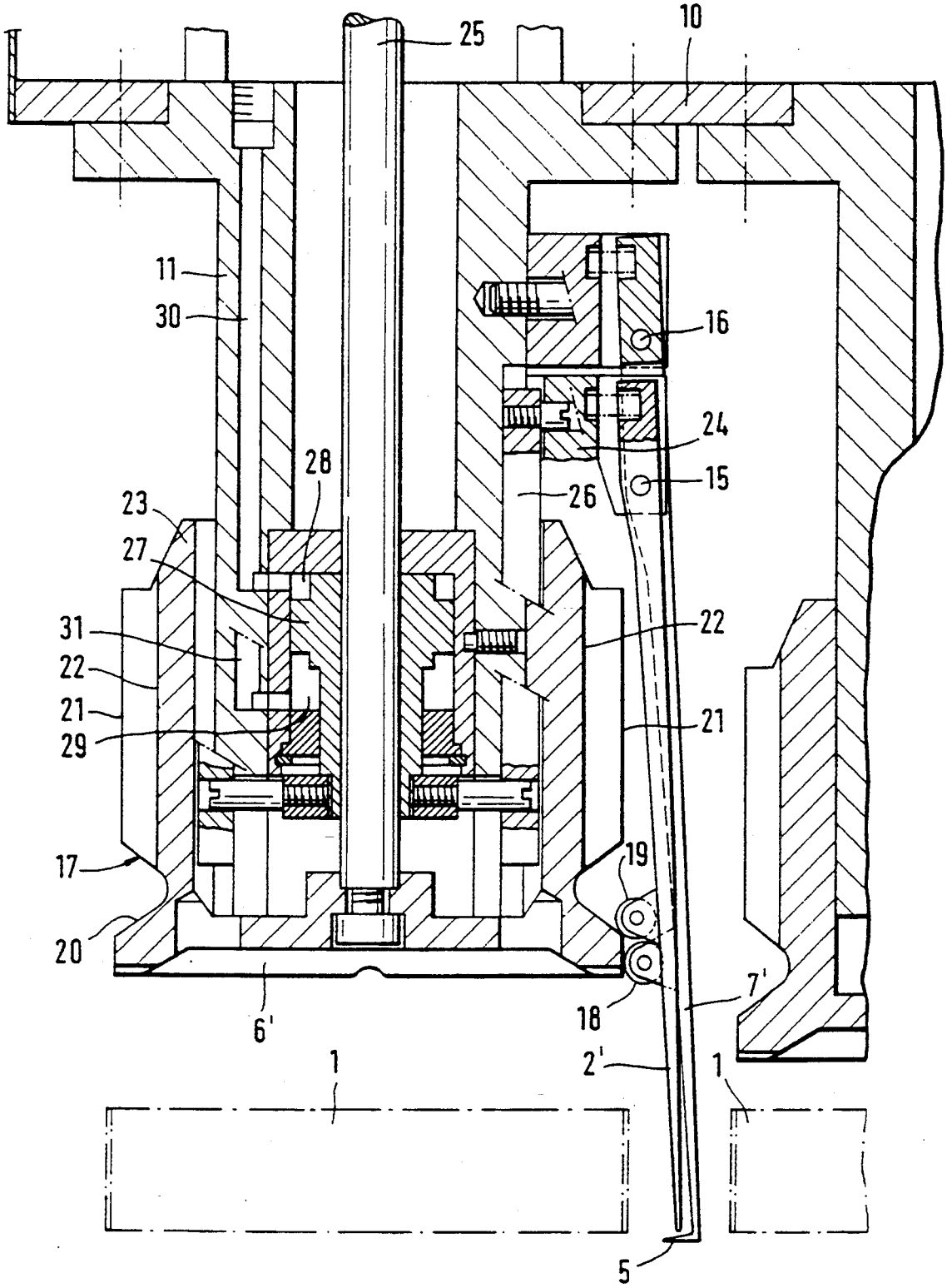
FIG. 3 is a cross sectional view through a modified embodiment of the invention.

The embodiment of FIG. 3 differs from that of FIGS. 1 and 2 essentially in that both the grippers 2' and the arms 7' which carry the extension pieces 5' at the lower end are constructed as levers. The grippers 2' are mounted movably about the pivot 15 and the arms 7' are mounted movably about the pivot 16. FIG. 3 also shows that the extension pieces 5' surround the grippers 2 from below.

The lever-like grippers 2' and the arms 7' are driven, in the embodiment of FIG. 3, by a carriage 17 which is connected to the ejector 6' or is formed integrally therewith. This carriage 17 acts on rollers 18 and 19, the roller 18 being connected to the arm 7 and the roller 19 being connected to the gripper 2. The ejector 6 and the carriage 17 are driven by the piston rod 25. The associated pneumatic cylinder is not shown.

The ejector 6' first maintains a relatively large spacing from the stack 1; during movement of the controlled ejector 6' controlled movement of the grippers 2 and the levers 7 is also produced by way of the carriage 17 and the rollers 18 and 19. In this way, the gripping procedure and the release movement can be controlled. It can easily be achieved that at the end of the path of the ejector 6' the grippers 2' release the stack 1, and furthermore that the extension pieces 5' are also retracted at a suitable moment.

Whereas, in the lower part, both rollers 18 and 19 are guided by the part 20 of the carriage 17, the roller 18 of the arm 7 moves on the part 21 of the carriage, whereas the part 22 of the carriage controls the roller 19 of the gripper 2. It is clear that as a result of these different camming surfaces, which are offset with respect to one another on the periphery of the sleeve 23, different movements of the arm 7 and the gripper 2 can be brought about.

In the embodiment of FIG. 3, it is further provided that the bearing part 24 for the pivot 15 is constructed to be displaceable in the direction of the central longitudinal axis of piston rod 25. To this end, a slide part 26 which carries the bearing part 24 is provided. This slide part 26 is connected to the piston 27, and the cylinder spaces 28 and 29 can be acted upon by way of the lines 30 and 31, so that the bearing part 24 can be pushed back and forth to operate the grippers 2'. In this way, it is possible for the front end of the gripper 2' to reach into the upper part of the hollow in the same way as in the embodiment of FIG. 1. On the other hand, the apparatus can be adapted to the respective conditions, so that it is also possible to dispense with penetration of the front end of the gripper 2' if the dimensions of the goods or of the hollow do not permit this.

Figure 4:
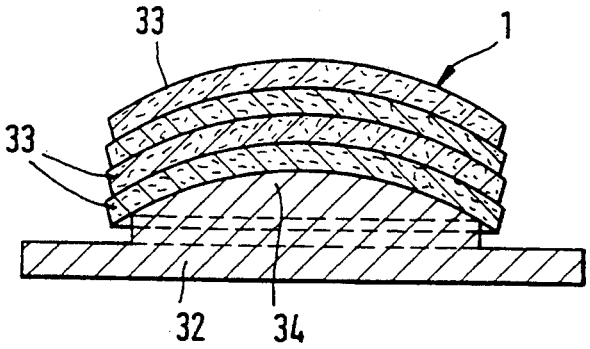
FIG. 4, FIG. 5 and FIG. 6 are enlarged cross-sectional views showing a process according to the invention.

FIG. 4 shows a support 32 which has a convex curvature 34. The stack 1 of goods lies on this curved surface. The individual slices, e.g. sausage slices 33, are laid directly on the curved surface 34 after cutting. It will be noted that in the drawing relatively thick slices 33 are illustrated. In practice, the slices can also be comparatively thin.

Figure 6:
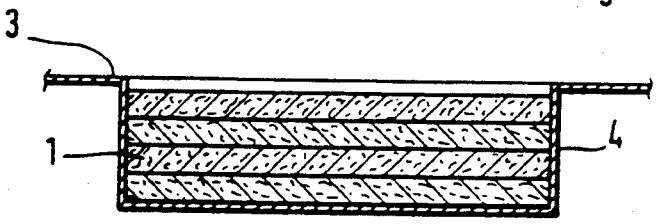

The stack so formed is gripped by the grippers 2, as illustrated in FIG. 4. The grippers have, for example, extension pieces 5'' which grip below the stack. The grippers maintain the curved shape of the stack. In this way, the stack is brought from the support 32 to a position above the hollow to be filled. In this position, the grippers 2 move, for example outwards, so that the stack is released and can fall into the hollow 4, as illustrated in FIG. 6. Since the stack in this case again adopts the conventional shape of a cylinder section, the diameter of the stack is increased so that the hollow 4 is completely filled.

Figure 5:
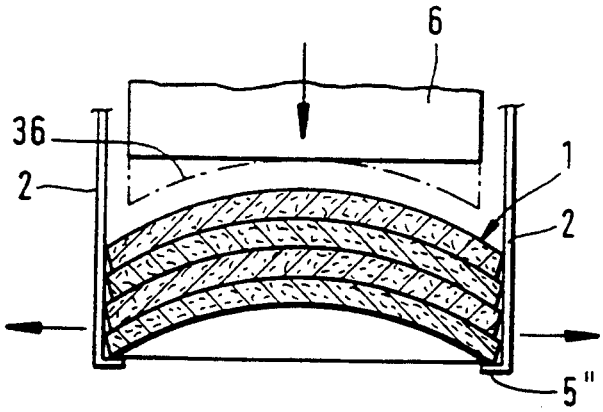

The stack can be deposited in the hollow using the ejector 6 (FIG. 5). The ejector can also have a concave shape matched to the convex shape of the stack, as illustrated in FIG. 5 by dot-and-dash lines 36.

Figure 7:
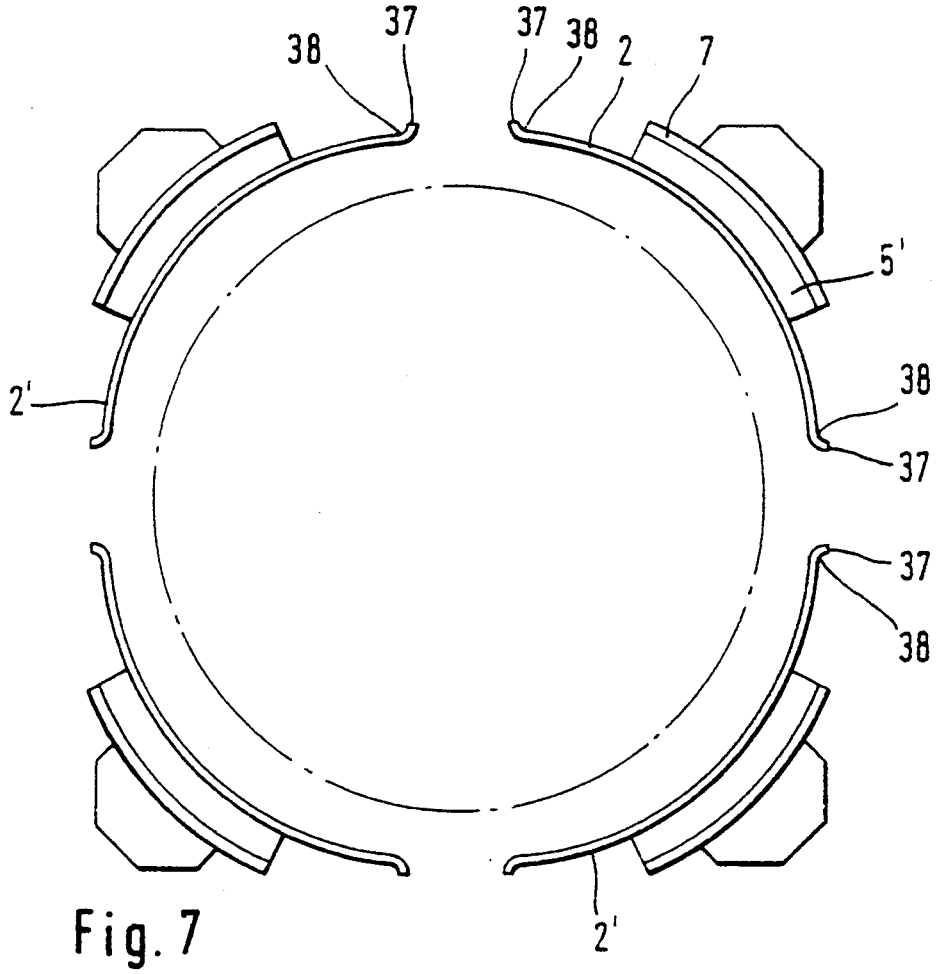
FIG. 7 and FIG. 8 are plan views of a detail of the invention.

FIG. 7 shows a partial cross-sectional view of a gripper construction according to the invention. The grippers 2 are in this case shaped like dishes and have a substantially part-cylindrical shape in cross-section. The edges 37 of the grippers 2 facing one another are each provided with rounded ends 38, so that when the grippers 2 are manufactured from, for example, sheet metal, the edges of the grippers do not damage the goods being packaged.

Figure 8:
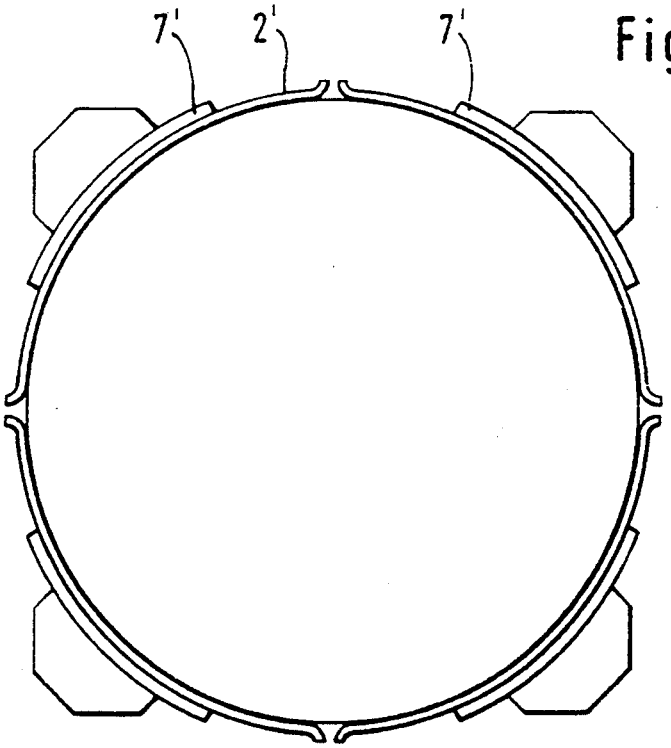

As FIG. 8 shows, the grippers can be constructed such that they form virtually a complete cylinder in the closed state. Even if the goods for packaging are somewhat deformed under the action of the grippers, damage by the edges 37 of the grippers is still prevented.

Figure 9:
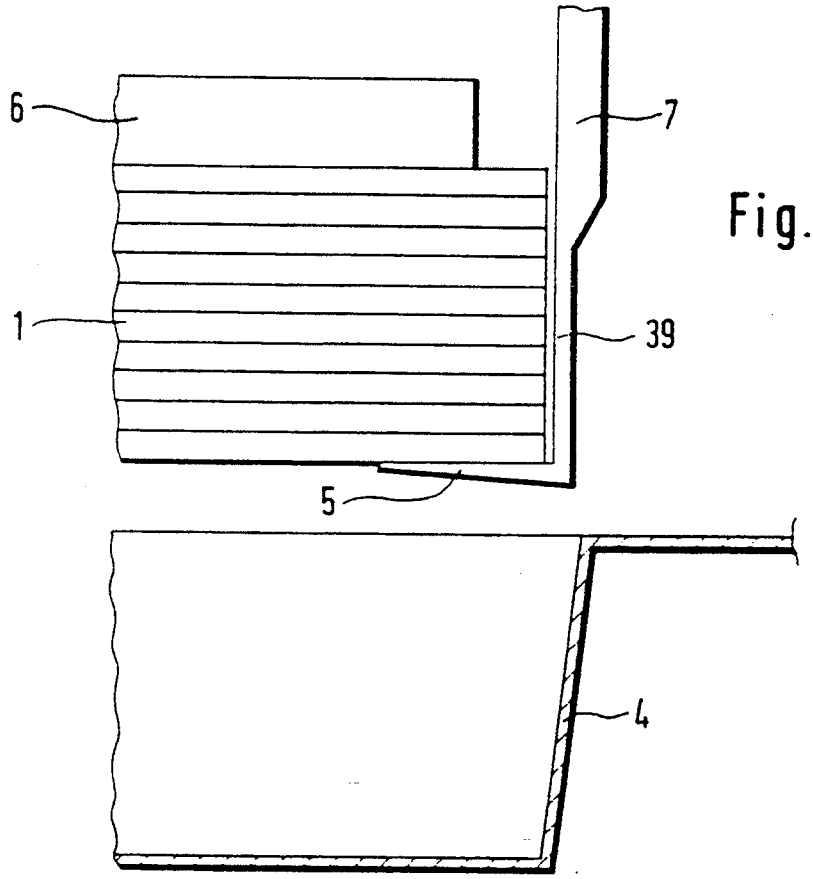
FIG. 9 and FIG. 10 are cross-sectional views of another detail of the invention, in different operating positions.
Figure 10:
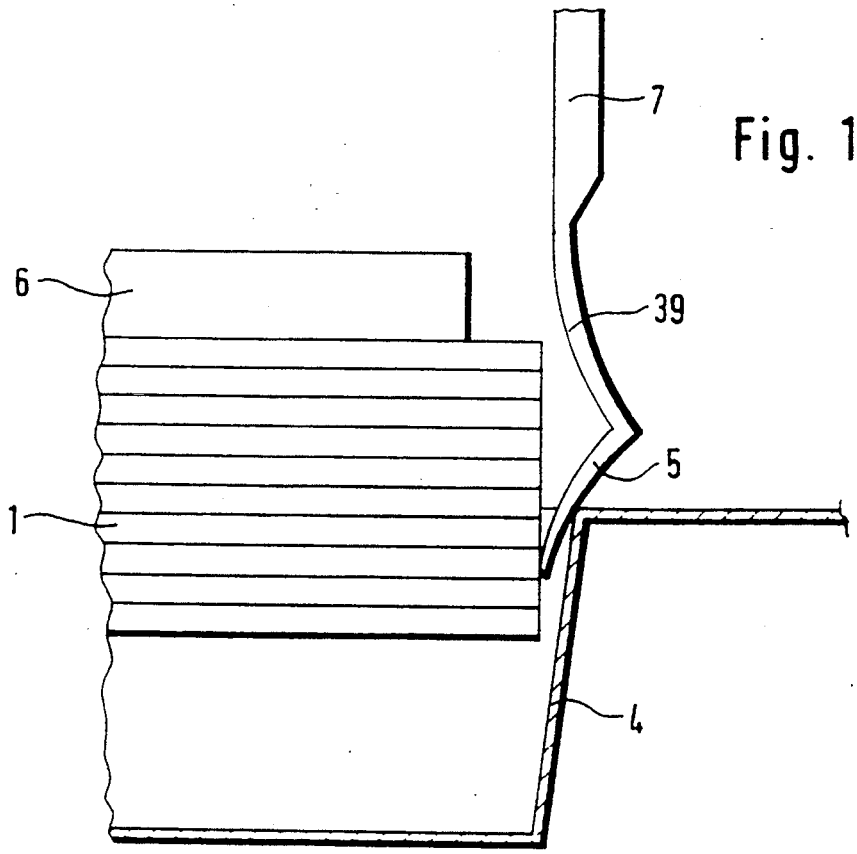

FIGS. 9 and 10 show an embodiment of the lower ends of the arms 7 and of the extension pieces 5. By suitable shaping, in particular as a result of a small dimension in the region 39 of the arms 7 and also a small dimension of the extension pieces 5 which grip under the goods 1, the extension pieces 5 bend downwards under the action of ejector 6 so that the goods 1 can be deposited in the hollow 4. The bent extension pieces 5 can in this case also reach slightly into the hollow 4.

In general, the stacks of goods to be packaged are circular in outline. However, this is not necessary for the invention. Goods having different outlines can also be packaged.

We claim:

1. Apparatus for inserting a stack of goods into hollow containers for packaging, each of said containers having an upper open end with upper edges and internal dimensions substantially conforming to external peripheral dimensions of said goods for receiving said goods in the hollow interior of each container when in an inserting position, said apparatus comprising:

support means;

two pairs of circumferentially spaced elongated grippers having upper ends movably mounted on said support means and extending therefrom toward said upper open end of one of said hollow containers, each pair of grippers comprising a first gripper having a configuration for engaging against at least part of the external periphery of said stack of goods for guiding said stack of goods in said inserting position, a lower end on said first gripper insertable into said upper open end of said one of said hollow containers slightly beyond said upper edge thereof in said inserting position, a second gripper radially outwardly of said first gripper, a lower end on said second gripper, a radially inwardly extending extension on said lower end of said second gripper engageable in supporting relationship under a portion of said stack of goods, said extension being disposed above said upper open end of said one of said hollow containers in said inserting position, and an aperture in said first gripper for receiving therethrough said extension on said second gripper;

first drive means mounted on said support means operatively connected to said first gripper for moving said first gripper inwardly for guiding engagement with said stack of goods in said inserting position and outwardly for releasing said stack of goods after insertion into said hollow container; and second drive means mounted on said support means operatively connected to said second gripper for moving said second gripper independently of said first gripper inwardly into supporting engagement of said extension thereon with said stack of goods and outwardly for releasing said stack of goods in said inserting position for insertion of said stack of goods into said hollow container when said stack of goods is guided by said first gripper during said insertion.

2. The apparatus as claimed in claim 1 wherein:

said extension on said lower end of said second gripper is bendable to facilitate partial insertion of said extension thereon into said upper open end of said one of said hollow containers during said insertion of said stack of goods.

3. The apparatus as claimed in claim 1 and further comprising:

ejector means mounted on said support means for substantially reciprocal movement toward and away from said one of said hollow containers for engaging and stripping said stack of goods from said first grippers for insertion of said stack of goods into said hollow container.

4. The apparatus as claimed in claim 1 wherein:

said lower ends of said first grippers project toward said one of said hollow containers beyond said extension on said second grippers.

5. The apparatus as claimed in claim 1 wherein:

said first grippers have a substantially cylindrically curved cross-sectional configuration with longitudinal side edges and said side edges are rounded.

6. The apparatus as claimed in claim 1 wherein:

said first and second drive means are disposed radially inwardly of said upper ends of said first and second grippers, respectively.

* * * * *